US006719448B2

(12) United States Patent
Tedman et al.

(10) Patent No.: US 6,719,448 B2
(45) Date of Patent: Apr. 13, 2004

(54) METHOD AND APPARATUS FOR THE SIMULTANEOUS PRODUCTION OF DIFFERENTLY CHARACTERIZED EXTRUDATES

(75) Inventors: Paul Tedman, Sabetha, KS (US); Bobbie W. Hauck, Sabetha, KS (US)

(73) Assignee: Wenger Manufacturing, Inc., Sabetha, KS (US)

( * ) Notice: Subject to any disclaimer, the term of this patent is extended or adjusted under 35 U.S.C. 154(b) by 5 days.

(21) Appl. No.: 10/172,298

(22) Filed: Jun. 13, 2002

(65) Prior Publication Data

US 2003/0231544 A1 Dec. 18, 2003

(51) Int. Cl.[7] ..... B01F 7/08; B01F 15/02

(52) U.S. Cl. ..... 366/76.3; 366/76.6; 366/91; 366/157.2; 366/158.2; 366/290; 366/292; 425/205

(58) Field of Search ..... 366/14, 15, 76.1, 366/76.3, 76.4, 76.6, 76.93, 91, 155.1, 156.1, 157.1, 157.2, 158.2, 158.3, 158.4, 177.1, 290, 292, 293, 295; 425/204, 205, 208, 209

(56) References Cited

U.S. PATENT DOCUMENTS 3,916,981 A * 11/1975 Miki
5,407,268 A * 4/1995 Henrich ..... 366/156.1
6,468,464 B1 * 10/2002 Eckardt et al.

* cited by examiner

*Primary Examiner*—Charles E. Cooley
(74) *Attorney, Agent, or Firm*—Hovey Williams LLP

(57) ABSTRACT

Material processing apparatus (10) is provided for the simultaneous production of different characterized final products using a single, initially processed product stream. The apparatus (10) includes a barrel assembly (12) having an elongated, tubular barrel (16) with a flighted, axially rotatable screw (26) within the barrel, and an additive incorporation assembly (14) coupled with the barrel (16) and having a plurality of individual mixing chambers (34, 36) configured to receive and process individual, separate streams of product from the barrel assembly (12). Individual additive injectors (52, 54) are also provided for injection of additives such as colorants or the like into the respective product streams for mixing with the chambers (34, 36). Preferably, the assembly (14) includes a flow divider (32) having plural separate passageways (46, 48), which are in communication with the corresponding mixing chambers (34, 36). Each mixing chamber includes a tubular housing (56, 72) together with an internal, axially rotatable mixing member (104, 106). The mixing members are mounted on a common shaft (96), the latter being connected to screw (26).

20 Claims, 1 Drawing Sheet

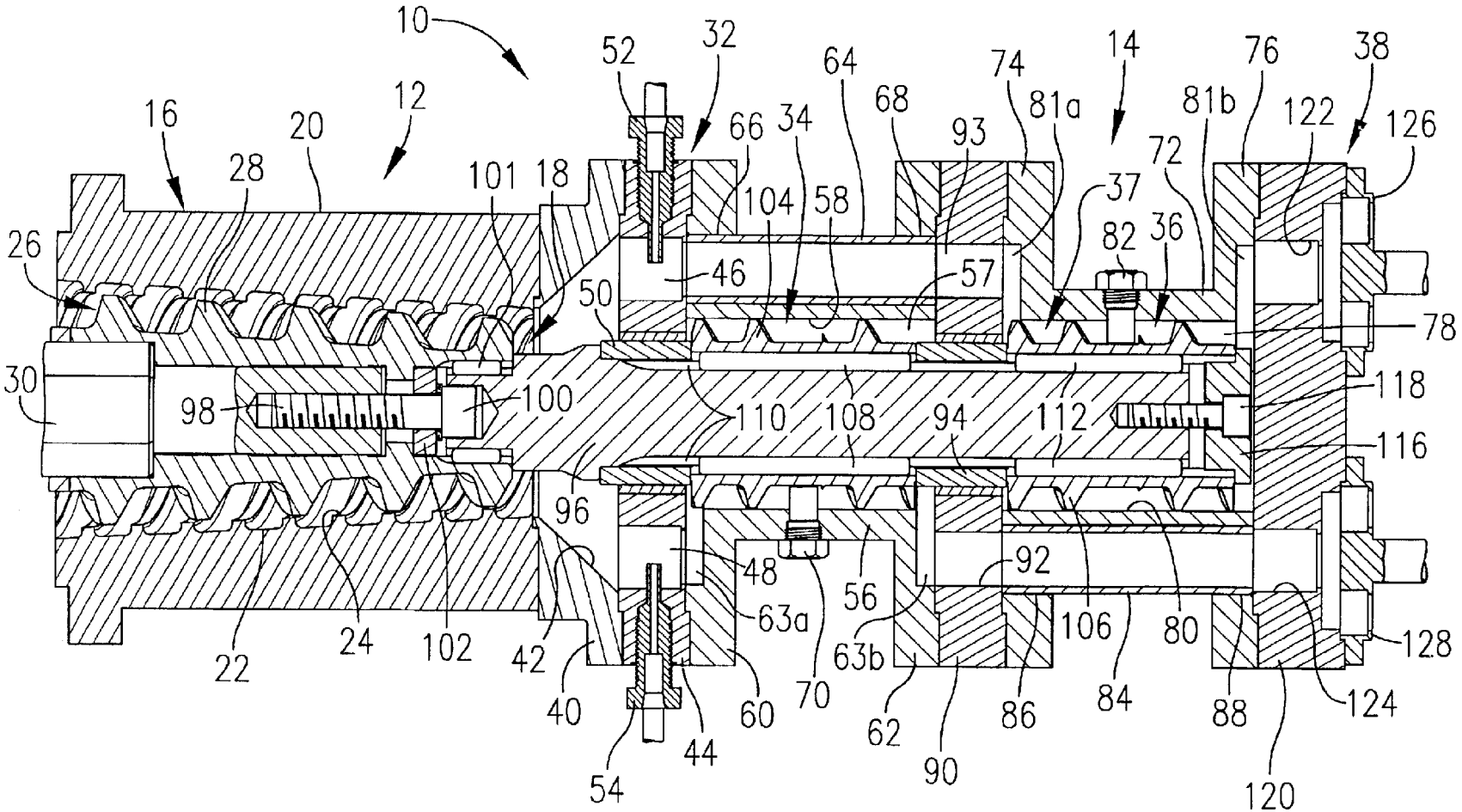
10
12
14
16
18
20
22
24
26
28
30
32
34
36
37
38
40
42
44
46
48
50
52
54
56
57
58
60
62
63a
63b
64
66
68
70
72
74
76
78
80
81a
81b
82
84
86
88
90
92
93
94
96
98
100
101
102
104
106
108
110
112
116
118
120
122
124
126
128

METHOD AND APPARATUS FOR THE SIMULTANEOUS PRODUCTION OF DIFFERENTLY CHARACTERIZED EXTRUDATES

BACKGROUND OF THE INVENTION

1. Field of the Invention

The present invention is broadly concerned with a method and apparatus permitting simultaneous production of different output streams, and especially extrudate streams. More particularly, the invention is concerned with such methods and devices wherein an upstream barrel assembly is provided for initial processing of material, along with a downstream additive incorporation assembly serving to separate and process with individual additives a plurality of streams of the initially processed material.

2. Description of the Prior Art

Producers of pet foods very commonly wish to provide the feeds as cooked extrudates having different colors or other distinguishing characteristics such as shapes, flavors and/or aromas. In the past, it has been necessary for pet food manufacturers to provide separate extruders for the different products, which after production are mixed to give a combined feed. Alternately, it is possible to initially run a product of one color, followed by a separate run to give a differently colored product. The first alternative is objectionable because of the expense required to purchase and maintain separate extruders and related equipment (e.g., storage and metering bins, blending equipment and dust collectors); the latter approach substantially cuts overall feed production because of the need to change over the single extruder for different products.

Attempts have been made in the past to provide a single extruder or similar device capable of simultaneously producing different characterized products. For example, U.S. Pat. No. 5,486,049 describes an apparatus including means for dividing an incoming product stream so as to allow incorporation of different additives into the divided streams. However, the '049 device is excessively complex, requiring specialized plate assemblies capable of generating a network of voids in the individual streams. Moreover, the mixing chambers include only static mixing devices, which result in very large pressure drops and the consequent need to generate high magnitude forces to propel the material through the mixing chambers.

Canadian Patent No. 1,230,005 describes a twin screw extruder device wherein the individual outputs from the twin screws of the machine are independently treated; these streams are then combined in a downstream region of the device to form a single extrudate. However, twin screw equipment is relatively expensive, and more complex than single screw devices.

SUMMARY OF THE INVENTION

The present invention overcomes the problems outlined above and provides an improved material processing apparatus designed for the simultaneous production of two differently characterized outputs or extrudates. Broadly speaking, the apparatus of the invention includes an elongated barrel presenting an outlet with an elongated, flighted axially rotatable screw within the barrel in order to move material to be processed toward and through the barrel outlet. An additive incorporation assembly is coupled with the barrel outlet and includes a flow divider having a plurality of separate outputs which is operable to separate the material passing through the barrel outlet into plural separate material streams. The overall additive incorporation assembly further includes a plurality of individual mixing chambers each including a tubular housing presenting a housing input and a housing output, and an elongated, axially rotatable mixing element within the housing. Each of the flow divider outputs is operably coupled with the input of one of the mixing chamber housings so that each of the separate material streams is directed to a respective mixing chamber. Finally, additive injectors are provided for additional of selected additives to each of the separate material streams.

In preferred forms, the plural mixing chambers (which generally number between two and four chambers, but may be in excess of this number) are in substantial axial alignment with each other and with the upstream barrel. Moreover, it is preferred that a drive coupling be provided between the barrel screw and the mixing elements such that rotation of the barrel screw effects rotation of the mixing elements. The additive injectors may be provided at or adjacent the flow divider for addition of respective additives to each of the material streams; however, these injectors may also be provided at the region of the individual mixing chambers if desired.

BRIEF DESCRIPTION OF THE DRAWINGS

The single FIGURE is a fragmentary vertical sectional view of a preferred processing apparatus in accordance with the invention.

DETAILED DESCRIPTION OF THE PREFERRED EMBODIMENT

Turning now to the drawing, material processing apparatus 10 in accordance with the invention broadly includes a barrel assembly 12 and a downstream additive incorporation assembly 14 operably coupled to assembly 12. The apparatus 10 is designed to process a material, such as a typical extrusion product, and to divide an output into two or more streams for incorporation of respective additives into the streams. In this way, differently characterized products (e.g., having different color additives) may be simultaneously produced using only a single apparatus 10.

In more detail, the barrel assembly 12 includes an elongated, sectionalized barrel 16 presenting a barrel outlet 18. The barrel is most preferably that of a conventional extruder, such as those depicted in U.S. Pat. No. 5,694,833, incorporated by reference herein. In the illustrated embodiment, the final tubular head 20 of the barrel 16 is illustrated, and includes a generally frustoconical central passageway 22 provided with helical flighting 24. An elongated, axially rotatable, helically flighted, sectionalized screw assembly 26 is located within barrel 16 in order to move material to be processed from the barrel inlet (not shown) toward and through barrel outlet 18. Again, the preferred screw assembly 26 is that typical of extrusion devices. In this instance, the final frustoconical screw section 28 is illustrated, which is mounted on central shaft 30 for axial rotation thereof, however, the overall assembly is made up of a plurality of axially aligned screw sections each supported on the shaft 30.

The additive incorporation assembly 14 broadly includes a flow divider 32, first and second, axially aligned, individual mixing chambers 34 and 36, a central, elongated mixing element 37, and endmost die assembly 38.

The flow divider 32 includes a first stationary block 40 coupled to the butt end of barrel head 20 and presenting an outwardly diverging frustoconical passage 42 which communicates with barrel outlet 18. Additionally, the divider 32 includes a stationary annular block 44 secured to block 40 and having a pair of individual spaced apart passageways 46, 48 therethrough, each of the latter communicating with frustoconical passage 42 and thus defining separate outputs. The inner section of block 44 includes an annular bearing 50, whereas a pair of additive injectors 52, 54 are threadably supported within the block 44 and respectively extend into and communicate with the corresponding passageways 46, 48.

The first mixing chamber 34 includes a tubular housing 56 which is connected to block 44 as shown and presents a central, internal, circular in cross-section through passage 57 and a smooth internal surface 58 (optionally, this internal surface may be equipped with axial or helical ribbing). The housing 56 includes radially outwardly extending endmost flanges 60, 62 permitting attachment of the housing. Short radial material transfer passages 63*a* and 63*b* are provided in flanges 60 and 62 as shown; the passage 63*a* leads from passageway 48 to through passage 57 thus defining the input of the housing, while passage 63*b* leads from through passage 57 and defines the housing output. The housing 56 also supports an elongated, tubular conduit 64 outside of through passage 57 which extends through openings 66, 68 provided through the flanges 60, 62 as shown, i.e., the conduit 64 is in communication with passageway 46. One or more threaded, adjustable, flow-disrupting bolts 70 extend through housing 56 and into through passage 57; these optional bolts may be used to assist processing within the chamber 34 as will be described.

The second mixing chamber 36 is similar to chamber 34, and includes a housing 72 presenting endmost radial flanges 74, 76 and a central through passage 78 defined by smooth inner wall 80 (optionally, this internal surface may be equipped with axial or helical ribbing). Material transfer passages 81*a* and 81*b* are formed in flanges 74 and 76. The passage 81*a* defines the housing input and communicates with through passage 78, while the passage 81*b* is likewise in communication with through passage 78 and defines the housing output. One or more optional bolts 82 similar to the bolts 70 may also be provided. In addition, the chamber 36 includes an elongated conduit 84 exterior of through passage 78 which passes through flange openings 86 and 88.

It will be seen that the chambers 34 and 36 are separated and isolated from one another by means of intermediate annular bearing block 90, the latter being secured to flanges 62 and 74 by conventional connectors (not shown). The block 90 includes openings 92 and 93 therethrough, with the opening 92 communicating with passage 63*b* and conduit 84, while opening 93 communicates with conduit 64 and passage 81*a*. The inner portion of the block 90 supports an annular bearing 94.

The mixing element 37 includes an elongated central shaft 96 extending the full length of assembly 14. The upstream end of shaft 96 is directly connected to the final section 28 of screw 26, so that rotation of the latter likewise rotates the shaft 96. Such connection is effected by means of an elongated central bolt 98 extending into screw shaft 30, with the head 100 of the bolt being received within a recess provided in the end of shaft 96. Also, the shaft 96 is keyed to the screw section 28 via keys 101. A bearing washer 102 is also provided adjacent head 100 as illustrated. The shaft 96 is supported for axial rotation by means of the bearings 50 and 94 supported by blocks 44 and 90, respectively.

The shaft 96 supports a pair of axially aligned but separate, elongated, tubular, flighted mixing members 104 and 106. The member 104 is secured to shaft 96 via opposed keys 108 which are seated within keyways 110 formed in shaft 96. As shown, the member 104 is positioned between the blocks 44 and 90 within housing 56. Similarly, the member 106 is secured to shaft 96 by means of opposed keys 112 within the shaft keyways 110. The member 106 is located within housing 72 between bearing 94 and an end cap 116, the latter being secured to shaft 96 through bolt 118.

Die assembly 38 is in the form of a die block 120 secured to flange 76. The block 120 has a pair of spaced openings 122 and 124 therethrough, which are respectively in communication with transfer passageway 81*b* and conduit 88. The external face of the block 122 is equipped with apertured extrusion dies 126, 128 which are respectively in communication with the openings 122 and 124.

In the operation of apparatus 10, a material to be processed is fed into barrel 16 and passes along the length of barrel assembly 12. During such passage, the material is normally subjected to increasing levels of temperature, pressure and shear in order to at least partially cook the material. For example, the material being processed may be the ingredients making up a conventional pet food, including quantities of protein, starch and lipids.

As the material leaves barrel outlet 18, it enters the flow divider 32, first passing through passage 42 of block 40 and then into and through the passageways 46 and 48 of block 44. It will be appreciated in this respect that once the material enters the passageways 46 and 48, separate streams of the material from the barrel assembly 12 are created. As the respective streams pass through the passageways 46 and 48, appropriate additives are injected via the injectors 52 and 54. For example, a red colorant may be injected at injector 52, whereas a green colorant may be injected through injector 54.

Considering first the stream passing through passageway 48 and injected with green colorant, such material traverses passageway 63*a* and then enters the central through passage 57 of housing 56. As the material passes along the length of the through passage 57, it is fully mixed owing to the rotation of flighted mixing member 104. In addition, the presence of the flow-disrupting bolt(s) 70 assists in the mixing of the material and the colorant. This combined action insures that the green-colored stream is substantially homogeneous in color and consistency as it passes through exit passage 63*b* and enters opening 92 for passage through conduit 88. Ultimately, this stream passes through die block opening 124 and final extrusion die 128, producing a green-colored extrudate.

The stream passing through passageway 46 and injected with red colorant first traverses conduit 68 and then passes through block opening 93 and passage 81*a*. At this point, the red colored substream is mixed within second housing 72 because of the rotation of mixing member 106 and the presence of bolt(s) 82. The resultant uniformly and homogeneously mixed stream then passes through passage 81*b* and into and through die block 122 and extrusion die 126. This creates a red-colored extrudate stream.

It will thus be appreciated that the apparatus 10 is capable of simultaneously producing differently colored substreams, eliminating the need for separate equipment to achieve this end. Of course, a wide variety of different additives can be injected using the injectors 52, 54. Thus, additives such as colorants, emulsifiers, acidifying agents, flavorants, aroma agents, nutraceuticals, vitamins, and/or minerals may be injected into the substreams so as to create differently characterized end products. While the injectors 52 and 54 in the illustrated embodiment are positioned upstream of the individual mixing chambers 34, 36, the invention is not so limited. That is, additives could also be injected into the mixing chambers if desired; broadly speaking, so long as respective additives are added upstream of the corresponding mixing chamber outlets, the ends of the invention can be achieved.

In practice, substantially all of the cooking of the product occurs within barrel assembly 12, with assembly 14 being provided for additive incorporation purposes. The operating conditions within barrel assembly 12 are thus chosen to achieve the desired level of cook (e.g., protein denaturation and/or starch gelatinization).

While use of the apparatus 10 has been described in connection with pet food manufacture, the invention may be employed to produce essentially all types of food or non-food products normally producing using extrusion or similar techniques. Also, it would be possible to arrange the final die assembly of the apparatus 10 so that the individual, differently characterized streams are mixed prior to or at the time of extrusion, thereby producing a single extrudate of multiple properties. In the case of two differently colored streams, merger thereof would produce a single, multi-colored extrudate.

EXAMPLES

The following examples set forth processes for the production of a two-color pet food. It is to be understood, however, that these examples are provided by way of illustration and nothing therein should be taken as a limitation upon the overall scope of the invention.

Apparatus as depicted in the FIGURE was used for the simultaneous production of a pet food made up of red-colored fish-shaped extruded pieces and triangle-shaped yellow or gold-colored extruded pieces. In particular, the upstream barrel section was in the form of a Wenger X165 single screw extruder made up of seven tubular externally jacketed heads, with heads 2–7 provided with removable flighted internal sleeves. A conventional extrusion screw used for pet food production also formed a part of the extruder setup. A Wenger Model 16 DDC preconditioner was provided upstream of the extruder barrel and was used for initially moisturizing and mixing the ingredients fed to the extruder.

The basic pet food recipe was a standard recipe including respective quantities of protein and starch. The dry recipe had a density of 576 kg/m$^3$. The red colorant was made up of 99.01% by weight water and 0.99% by weight Red No. 40 dye. The yellow or gold colorant was made up of 99.01% by weight water and 0.99% by weight Yellow No. 5 dye.

The dry recipe was fed into and through the DDC preconditioner and then into and through the X165 extruder device. As the now-cooked product left the extruder barrel, it passed into the flow divider 32 and was separated into two individual product streams; one such stream was directed through passage 46 and conduit 64 to second mixing chamber 36, whereas the other stream was directed through passage 48 into first mixing chamber 34. As the respective streams traversed the passages 46, 48, the red and yellow colorant was injected into the streams. In the chambers 34, 36, the separate streams were intimately mixed with colorant, by virtue of the action of the mixing members 104 and 106, as well as by the presence of the bolts 70 and 82. Of course, the mixing members 104 and 106 were rotated as at the same rotational speed as the extruder screw, by virtue of the mechanical interconnection of these components. In any case, the material passing from first chamber 34 was directed through conduit 88 and ultimately was extruded through die 128. In like manner, the material within second chamber 36 was extruded through die 126. The dual-colored product was then dried to a moisture level of approximately 6% wb.

The following table sets forth extrusion conditions recorded during two individual runs using the described apparatus and method.

TABLE 1

| DRY RECIPE INFORMATION | | Run #1 | Run #2 |
|---|---|---|---|
| Density | kg/m$^3$ | 576 | 576 |
| Rate | kg/hr | 1790 | 2472 |
| Feed Screw Speed | rpm | 38 | 54 |
| PRECONDITIONING INFORMATION | | | |
| Preconditioner Speed | rpm | 250 | 250 |
| Steam Flow to Preconditioner | kg/hr | 146 | 203 |
| Water Flow to Preconditioner | kg/hr | 198 | 227 |
| Preconditioner Additive | kg/hr | 107 | 150 |
| Moisture Entering Extruder | % wb | 22.52 | — |
| EXTRUSION INFORMATION | | | |
| Extruder Shaft Speed | rpm | 418 | 418 |
| Extruder Motor Load | % | 78 | 102 |
| Control/Temperature 2 nd Head | ° C. | 50/62 | 60 |
| Control/Temperature 3 rd Head | ° C. | 50/62 | 65 |
| Control/Temperature 4 th Head | ° C. | 50/50 | 55 |
| Control/Temperature 5 th Head | ° C. | 50/46 | 64 |
| Control/Temperature 6 th Head | ° C. | 70/70 | 77 |
| Control/Temperature 7 th Head | ° C. | 70/69 | 82 |
| Knife Drive Speed | rpm | 47 | 47 |
| FINAL PRODUCT INFORMATION | | | |
| Extruder Discharge Moisture | % wb | 25.61 | — |
| Extruder Discharge Density | kg/m$^3$ | 473 | — |

We claim:

1. Material processing apparatus comprising:

an elongated barrel having a barrel outlet, and an elongated, flighted axially rotatable screw within the barrel in order to move material toward and through the barrel outlet; and an additive incorporation assembly coupled with said barrel outlet and including— a flow divider having a plurality of separate outputs and operable to separate said material passing through the barrel outlet into a plurality of separate material streams, each stream passing through a corresponding output;

a plurality of individual mixing chambers each including a tubular housing presenting a housing input and a housing output, and an elongated, axially rotatable mixing element within the housing, said mixing chambers being in substantial axial alignment with each other, each of said flow divider outputs operably coupled with an input of one of said mixing chamber housings so that each of said separate material streams is directed to a respective mixing chamber; and a plurality of additive injectors for the addition of respective additives to each of said separate material streams.

2. The apparatus of claim 1, said mixing chambers being in substantial axial alignment with said barrel.

3. The apparatus of claim 1, including a drive coupling beween said screw and said mixing elements such that rotation of the screw effects rotation of said elements.

4. The apparatus of claim 1, said injectors operably coupled with said flow divider for addition of a respective additive to each of said streams.

5. The apparatus of claim 1, including a plurality of apertured extrusion dies, and structure operably coupling each of said housing outputs with an associated die.

6. The apparatus of claim 1, each of said mixing elements being flighted.

7. The apparatus of claim 1, including a common elongated shaft supporting each of said mixing elements.

8. An assembly for incorporation of additives into individual streams of material passing through the outlet of an upstream processing assembly, said additive incorporation assembly comprising:

a flow divider adapted for operative connection with said processing assembly outlet, said divider including a plurality of separate outputs and operable to separate said material passing through said processing assembly outlet into a plurality of separate material streams, each stream passing through a corresponding output;

a plurality of individual mixing chambers each including a tubular housing presenting a housing input and a housing output, and an elongated, axially rotatable mixing element within the housing, said mixing chambers being in substantial axial alignment with each other, each of said flow divider outputs operably coupled with an input of one of said mixing chamber housings so that each of said separate material streams is directed to a respective mixing chamber; and a plurality of additive injectors for the addition of respective additives to each of said separate material streams.

9. The apparatus of claim 8, said injectors operably coupled with said flow divider for addition of a respective additives to each of said streams.

10. The apparatus of claim 8, including a plurality of apertured extrusion dies, and structure operably coupling each of said housing outputs with an associated die.

11. The apparatus of claim 8, each of said mixing elements being flighted.

12. The apparatus of claim 8, including a common elongated shaft supporting each of said mixing elements.

13. A material processing method, comprising the steps of:

generating a flow of material;

dividing said material flow into a plurality of separate material streams;

directing each of said streams to an individual mixing chamber including a tubular housing having an input and an output, and an elongated, axially rotatable mixing element within the housing; and adding a respective additive to each of said streams upstream of each housing outlet and upstream of the associated mixing chamber, and mixing each additive with the corresponding material stream by rotation of said elements.

14. The method of claim 13, including the step of passing each of said streams through an individual apertured die plate after said mixing step.

15. The method of claim 13, said chambers being in substantial axial alignment.

16. Material processing apparatus comprising:

an elongated barrel having a barrel outlet, and an elongated, flighted axially rotatable screw within the barrel in order to move material toward and through the barrel outlet; and an additive incorporation assembly coupled with said barrel outlet and including— a flow divider having a plurality of separate outputs and operable to separate said material passing through the barrel outlet into a plurality of separate material streams, each stream passing through a corresponding output;

a plurality of individual mixing chambers each including a tubular housing presenting a housing input and a housing output, and an elongated, axially rotatable mixing element within the housing, at least one of said mixing chambers being in substantial axial alignment with said barrel, each of said flow divider outputs operably coupled with an input of one of said mixing chamber housings so that each of said separate material streams is directed to a respective mixing chamber; and a plurality of additive injectors for the addition of respective additives to each of said separate material streams.

17. Material processing apparatus comprising:

an elongated barrel having a barrel outlet, and an elongated, flighted axially rotatable screw within the barrel in order to move material toward and through the barrel outlet; and an additive incorporation assembly coupled with said barrel outlet and including— a flow divider having a plurality of separate outputs and operable to separate said material passing through the barrel outlet into a plurality of separate material streams, each stream passing through a corresponding output;

a plurality of individual mixing chambers each including a tubular housing presenting a housing input and a housing output, and an elongated, axially rotatable mixing element within the housing, there being a drive coupling between said screw and said mixing elements such that rotation of the screw effects rotation of said elements, each of said flow divider outputs operably coupled with an input of one of said mixing chamber housings so that each of said separate material streams is directed to a respective mixing chamber; and a plurality of additive injectors for the addition of respective additives to each of said separate material streams.

18. Material processing apparatus comprising:

an elongated barrel having a barrel outlet, and an elongated, flighted axially rotatable screw within the barrel in order to move material toward and through the barrel outlet; and an additive incorporation assembly coupled with said barrel outlet and including— a flow divider having a plurality of separate outputs and operable to separate said material passing through the barrel outlet into a plurality of separate material streams, each stream passing through a corresponding output;

a plurality of individual mixing chambers each including a tubular housing presenting a housing input and a housing output, and an elongated, axially rotatable mixing element within the housing, there being a common elongated shaft supporting each of said mixing elements, each of said flow divider outputs operably coupled with an input of one of said mixing chamber housings so that each of said separate material streams is directed to a respective mixing chamber; and a plurality of additive injectors for the addition of respective additives to each of said separate material streams.

19. An assembly for incorporation of additives into individual streams of material passing through the outlet of an upstream processing assembly, said additive incorporation assembly comprising:

a flow divider adapted for operative connection with said processing assembly outlet, said divider including a plurality of separate outputs and operable to separate said material passing through said processing assembly outlet into a plurality of separate material streams, each stream passing through a corresponding output;

a plurality of individual mixing chambers each including a tubular housing presenting a housing input and a housing output, and an elongated, axially rotatable mixing element within the housing, there being a common elongated shaft supporting each of said mixing elements, each of said flow divider outputs operably coupled with an input of one of said mixing chamber housings so that each of said separate material streams is directed to a respective mixing chamber; and a plurality of additive injectors for the addition of respective additives to each of said separate material streams.

20. A material processing method, comprising the steps of:

generating a flow of material;

dividing said material flow into a plurality of separate material streams;

directing each of said streams to an individual mixing chamber including a tubular housing having an input and an output, and an elongated, axially rotatable mixing element within the housing, said chambers being in substantial axial alignment; and adding a respective additive to each of said streams upstream of each housing outlet and mixing each additive with the corresponding material stream by rotation of said elements.

* * * * *